United States Patent [19]

Takahashi

[11] Patent Number: 4,623,010

[45] Date of Patent: Nov. 18, 1986

[54] TIRE BEAD PROTECTOR DEVICE

[75] Inventor: Kinya Takahashi, Hiroshima, Japan

[73] Assignee: Daikyo Co., Ltd., Japan

[21] Appl. No.: 677,482

[22] Filed: Dec. 3, 1984

[30] Foreign Application Priority Data

Dec. 3, 1983 [JP] Japan ..... 58-187358[U]
Jun. 16, 1984 [JP] Japan ..... 59-89770[U]

[51] Int. Cl.[4] ..... B60C 5/00; B60C 19/00; B65D 85/06

[52] U.S. Cl. ..... 152/450; 24/68 CT; 53/581; 150/54 B; 152/513; 152/539; 206/304; 211/23; 414/908

[58] Field of Search ..... 152/362 R, 450, 362 CS, 152/363, 364, 366, 217-218, 513-515, 539, 543, 379.4, 386, 403, 404; 24/69 WT, 68 CT; 211/23, 24; 285/229; 150/54 B; 206/416, 413, 303, 304, 523; 403/12; 414/426-429, DIG. 911, DIG. 910, DIG. 908; 53/204, 581; 493/954; 301/37 R

[56] References Cited

U.S. PATENT DOCUMENTS 1,355,042 10/1920 Harwood ..... 206/304
3,305,903 2/1967 McMahon ..... 206/304 X
4,304,279 12/1981 Thomas ..... 206/304 X

*Primary Examiner*—Edward Kimlin
*Assistant Examiner*—Thomas Bokan
*Attorney, Agent, or Firm*—Sixbey, Friedman & Leedom

[57] ABSTRACT

Bead protectors fittable to an opposed pair of tire bead portions are made of a thermoplastic resin. Each bead protector comprises a tubular portion fittable in the bead portion and a flange portion extending from the tubular portion via a curved portion and fittable to the outer side surface of the bead portion. The bead protector is integrally molded in an L-shaped radial cross section. Each of fastening bands comprises a stretchable portion and hooked plate-like metal members. When fitted to the tire bead portions, the bead protectors are interconnected by the fastening bands and elastically pulled toward each other axially of the tire by the stretchable portions, with the hooks in engagement with projections on the flange portions.

7 Claims, 14 Drawing Figures

TIRE BEAD PROTECTOR DEVICE

BACKGROUND OF THE INVENTION

Large-sized pneumatic tubeless tires for construction and industrial vehicles, etc. range from a minimum of 24 inches to a maximum of 57 inches in diameter. In weight, these tires range from a minimum of about 320 kg to a maximum of about 3,500 kg for wide use.

These tires are all of tubeless structure. When large-sized tubeless tires are raised in suspension by a forklift or the like for transport, the bead portions of the tire to which a wheel is to be attached are susceptible to damage. If the bead portion is damaged once, the tubeless tire becomes no longer serviceable as such. Since the bead portions for attaching the wheel are hermetically sealed for the large tubeless tire to retain its pneumatic pressure, damage to these portions must be avoided.

The same is true of off-road tires.

Accordingly Published Examined Japanese Utility Model Application No. SHO 53-19904 proposes a tire bead protector device.

As shown in FIGS. 1 and 2, this conventional device comprises a pair of annular bead protectors 3 made of iron and having an approximately L-shaped cross section, and a cushioning member 4 of soft material attached to the outer peripheral wall of each protector 3. The protectors 3 are fitted to the opposed bead portions of a large-size tubeless tire 1. A plurality of hooked springs 2 are engaged in holes 3*a* formed in the cylindrical portions of the pair of protectors 3 to fasten them to the tire. The tire thus packaged is then transported. However, the conventional packaging device, which comprises the annular iron protectors 3, cushioning members 4 and springs 2, is not easy to make and is costly to manufacture. Moreover, it is difficult for the cushioning member 4 to intimately fit to the inner surface of the bead portion. The cushioning member 4 is likely to come off the protector partly, permitting the protector 3 to directly contact the bead portion 1*a*, hence undesirable for the protection of the bead portion from damage. When the cushioning member comes off thus locally, it is difficult to attach the device to the bead portions. Furthermore there is the likelihood that the spring 2 will be disengaged or stolen during transport, hence undesirable for transport.

FIGS. 3 and 4 show another tire bead protector device which is disclosed in Published Unexamined Japanese Patent Application No. SHO 52-9205.

The disclosed device comprises a pair of annular bead protectors 5 made of rubber-like material and each adapted to protect the outer surface and bottom surface (as seen in FIG. 4) of the bead portion of a large-sized tubeless tire 1. The protector has a generally L-shaped cross section and comprises at least two divided segments. To use the device, the divided segments are fixedly connected together into an annular form by fitting or connecting members, and the protector is fitted to the central opening portion of the tire on each side thereof. The protectors and a practically unstretchable band 7 fitted around the tire tread are fastened to the tire by practically nonstretchable ropes or tapes 6 at several locations.

Published Unexamined Japanese Patent Application No. SHO 53-80601 discloses another tire bead protector device.

Although not shown, a used automotive tire is chiefly used as this device, while a regenerated tire, faulty tire or the like is also usable. Such a tire is circumferentially cut into two segments at the center of the tread. When the side wall portion of the segment extending to the bead portion is pushed inward to turn inside out, the segment makes a hollow frustoconical protective member with the tread portion serving as a flange. The segments thus shaped are fitted to the opposed bead portions of a tire for construction vehicles and fastened to the tire by a plurality of bands.

In the case of the foregoing publications Nos. SHO 52-9205 and SHO 53-80601, the protectors are fastened to the large-sized tubeless tire 1 with a plurality of bands which are usually steel bands. In this case, when the tire drops or is subjected to impact during transport, the steel band is likely to bite into the tire tread to cause damage thereto. In the present resource-saving, energy-saving age, it is extremely undesirable to render such an expensive large tubelss tire unusable owing to a defect created during transport. It has therefore been desired to overcome the drawbacks of the conventional devices and to provide an inexpensive useful packaging device for large-sized tubeless tires.

SUMMARY OF THE INVENTION

The present invention relates to a tire bead protector device which comprises a pair of tire bead protectors removably fittable to tire bead portions for protecting the bead portions against damage, and a plurality of fastening bands for disengageably interconnecting the protectors to hold them together against removal.

An object of the present invention is to provide a tire bead protector device which effectively protects tire bead portions from damage, has high durability and is easy to attach and remove.

Another object of the invention is to provide a tire bead protector device which is lightweight in itself, is easy to mold and does not require other reinforcing members.

Another object of the invention is to provide a tire bead protector device comprising protectors which can be held in intimate contact with tire bead portions with fastening bands, the fastening bands being easily engageable with and disengageable from the protectors.

Still another object of the invention is provide a tire bead protector device which comprises a pair of protectors fittable to tire bead portions and fastening bands for interconnecting the protectors without the likelihood of disengagement therefrom and in which the fastening bands are prevented from causing damage to the protectors.

Accordingly the present invention provides a tire bead protector device comprising a pair of annular bead protectors and a plurality of fastening bands for interconnecting the bead protectors, each of the bead protectors comprising a tubular portion with an outer periphery substantially fittable to the inner periphery of each bead portion of a tire and a flange portion extending from the outer end of the tubular portion and conforming to the outer side surface of the bead portion, the protector being integrally molded in a substantially L-shaped cross section having a curved portion, the bead protector being made of a thermoplastic resin, the flange portion being formed on its outer side surface with projections projecting radially outward thereof and arranged circumferentially thereof at a specified spacing, each of the fastening bands comprising a pair of plate-like metal members and a stretchable portion interconnecting the plate-like metal members, each of the plate-like metal members having a hook engageable with and disengageable from the projection, the fastening bands being positionable along the inner peripheries of the tubular portions of the bead protectors when the protectors are fitted to the tire bead portions, with the hooks in engagement with the projections of the bead protectors, to hold the protectors interconnected against removal axially of the tire, each of the plate-like metal members being positionable along the curved portion of the bead protector.

DETAILED DESCRIPTION OF THE INVENTION

Figure 1:
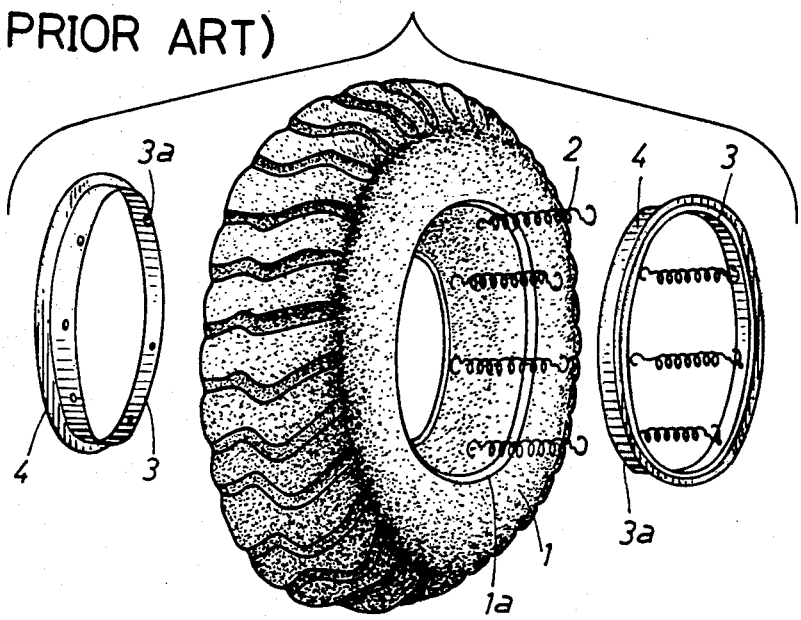
Fig 1 (PRIOR ART)
FIG. 1 is an exploded perspective view showing a conventional device.
Figure 2I:
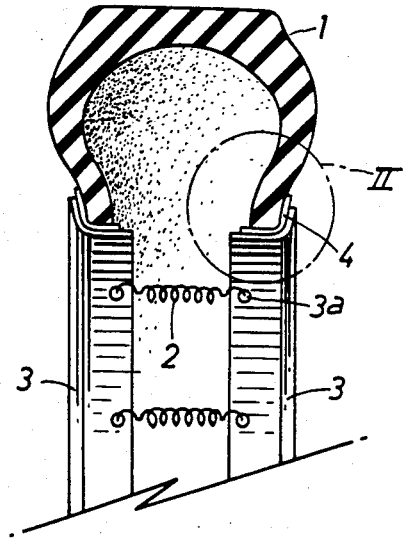
Fig 2(I) (PRIOR ART)
FIG. 2(I) is a fragmentary view in section showing the conventional device as assembled.
Figure 2:
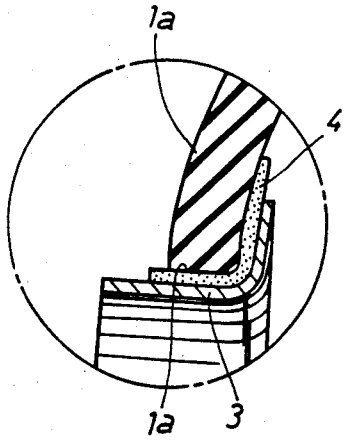
Fig 2(II) (PRIOR ART)
FIG. 2(II) is an enlarged view showing the portion indicated at II in FIG. 2(I)
Figure 3:
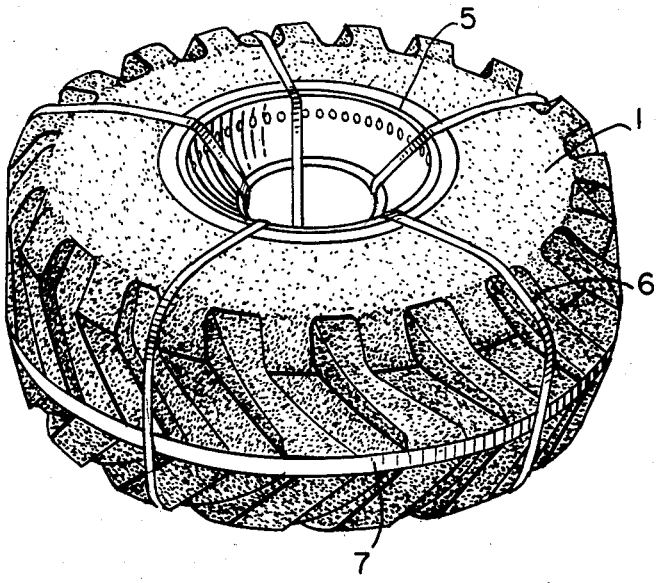
Fig 3 (PRIOR ART)
FIG. 3 is a perspective view showing another conventional device as assembled.
Figure 4:
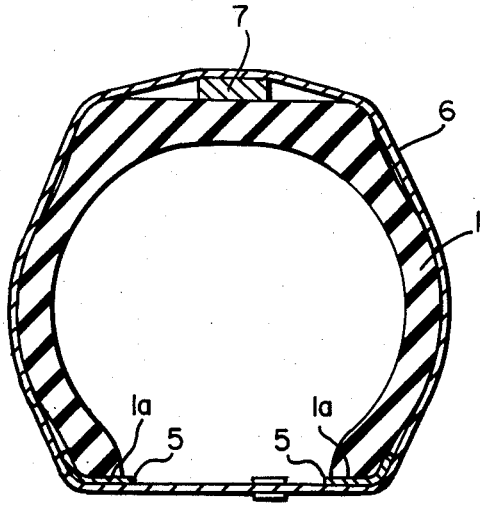
Fig 4 (PRIOR ART)
FIG. 4 is a fragmentary sectional view of the same.
Figure 5:
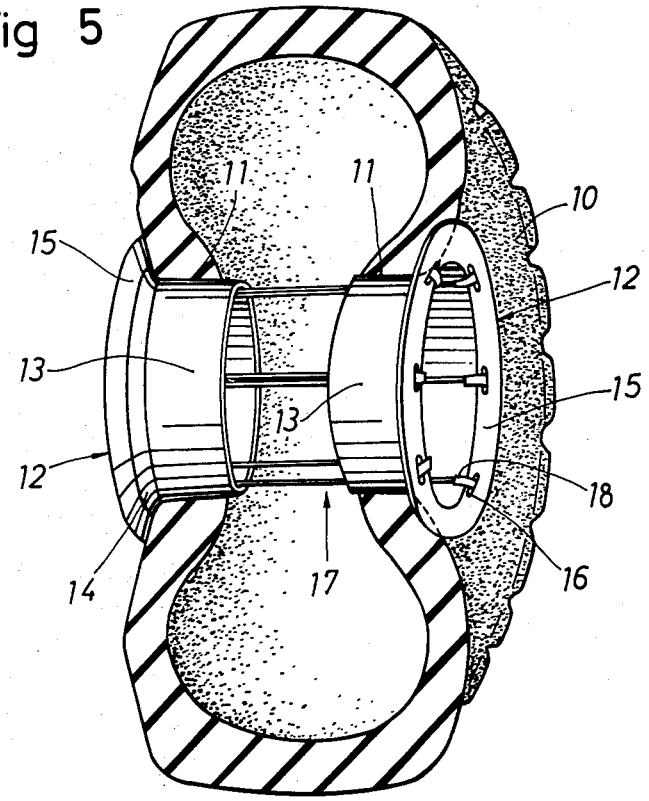
FIG. 5 is a perspective view showing a first embodiment of the invention as attached to a tire.

With reference to FIG. 5, a large-sized pneumatic tubeless tire 10 has opposed bead portions 11, to which bead protectors 12 are removably fitted from the outside.

Each bead protectors 12 comprises a tubular portion 13 with an outer periphery substantially fittable to the inner periphery of the bead portion 11 and a flange portion 15 extending radially outwardly from the outer end of the tubular portion 13 with a curved portion 14 formed therebetween to conform to the outer side surface of the bead portion 11. The bead protector 12 has an annular form substantially L-shaped in radial cross section.

The flange portion 15 is formed on its outer side surface with projections 16 projecting radially outward thereof to provide engaging cavities 16A and arranged circumferentially thereof at a specified spacing.

The bead protectors 12 can be held to the tire 10 by fastening bands 17 with their tubular portions 13 fitted in the bead portions 11.

Each fastening band 17 comprises a pair of plate-like metal members 18 and a stretchable portion 20 in the form of a solid rubber rod and fixedly inserted at each end in a socket 19 of each member 18. The metal member 18 has a hook 21 engageable with and disengageable from the projection 16.

Figure 6:
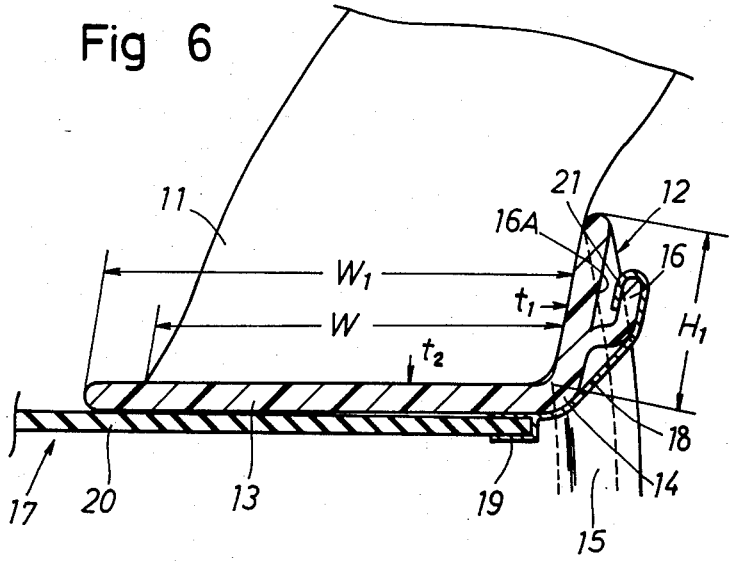
FIG. 6 is an enlarged fragmentary view in section showing the same.

When the bead protectors 12 are fitted to the bead portions 11, the fastening bands 17 are positioned along the inner peripheries of the tubular portions 13, with the hooks 21 in engagement with the corresponding projections 16 as seen in FIG. 6, with the result that the bead protectors 12 are prevented from removal axially of the tire by the elastic force of the stretchable portions 20. Each metal member 18 is positioned along the curved portion 14, and the hook 21 is engaged in the cavity 16A over the projection 16.

The bead protector 12 can be integrally formed from a thermoplastic resin by injection molding, compression molding or like process. Examples of useful thermoplastic resins are polyethylene, ABS resin, polypropylene, polyvinyl chloride, polycarbonate, polyacetal, nylon and polyethylene tetrafluoride. Such resins are used singly or in mixture. Preferred resins are polyethylene, polyamide and mixtures thereof.

The bead protector 12 must have strength withstanding hoisting and toughness against impact and local stress. Accordingly it is desired that the protector have the following properties.

(1) Tensile strength of at least 0.5 kg f/mm$^2$ according to JIS K 6911.

(2) Bending strength of 0.8 to 2.6 kg f/mm$^2$ according to JIS K 6911.

(3) Izod impact value of 0.6 to 1.8 kg f·cm/cm according to JIS K 6911. (These strength values are determined in an atmosphere of 20° C.)

For example, when the tensile strength is less than 0.5 kg f/mm$^2$, or the bending strength is less than 0.8 kg f/mm$^2$, or the Izod impact value is less than 0.6 kg f·cm/cm, the hoisting wire is likely to bite into the tire and cause damage to the tire, hence objectionable. Further if the bending strength exceeds 2.6 kg f/mm$^2$ or the Izod impact value is above 1.8 kg f·cm/cm, the bead protector becomes hard, brittle and susceptible to damage, hence undesirable.

Figure 7:
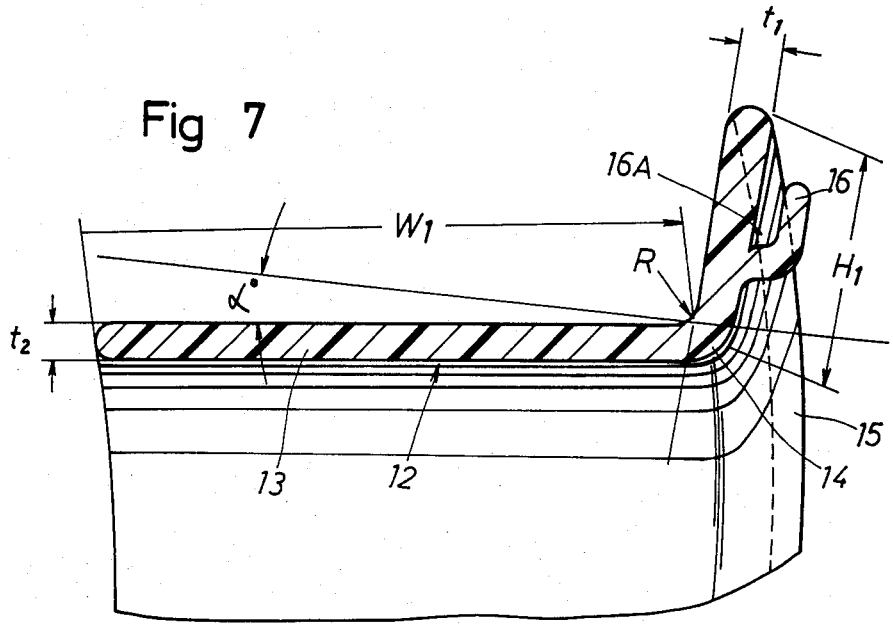
FIG. 7 is a fragmentary view partly in section of a bead protector included in the embodiment to illustrate dimensions thereof.

With reference to FIG. 7, the bead protector should preferably be so dimensioned as stated below.

(1) The length $W_1$ of the tubular portion is about 10 to about 30 mm larger than the width W of the tire bead portion 11.

(2) The height $H_1$ of the flange portion 15 must be sufficient to protect the outer side surface of the bead portion 11 and is therefore usually 30 to 45 mm. This permits provision of a desired number of projections 16 and affords sufficient rigidity to the projections 16.

(3) The wall thickness $t_2$ of the tubular portion 13, as well as the thickness $t_1$ of the flange portion 15, is preferably 4 to 10 mm. If the thickness is less than 4 mm, the wire is likely to bite into the protector and cause damage thereto. Thicknesses over 10 mm add to the weight and are not desirable.

(4) The outside diameter of the tubular portion 13 is approximately equal to the inside diameter of the tire bead portion.

(5) The angle $\alpha$ between the tubular portion 13 and the axis of the tire is approximately equal to the taper angle (about 5 degrees) of the tire bead portion.

Next, a specific example of bead protector prepared will be described with respect to the shape, dimensions and physical properties.

The protector was designed for use with construction vehicle tires 23.5-25 20 PR (JIS), etc. and prepared by injection molding from a thermoplastic resin composition comprising 55% by weight of polyethylene, 40% by weight of nylon and 5% by weight of pigment and other additives. The protector was 0.8 kg/mm$^2$ in tensile strength, 1.42 kg/mm$^2$ in bending strength and 1.00 kg f·cm/cm in Izod value as measured at 20° C. according to JIS K 6911. The protector had the following dimensions: length $W_1$ of tubular portion=120 mm, height $H_1$ of flange=35 mm, diameter of tubular portion=628 mm, taper angle $\alpha=5°$, flange thickness $t_1=5$ mm, tubular portion wall thickness $t_2=4$ mm, radius of curvature R of curved portion=6 mm, and thickness of projections=4 mm.

Figure 8:
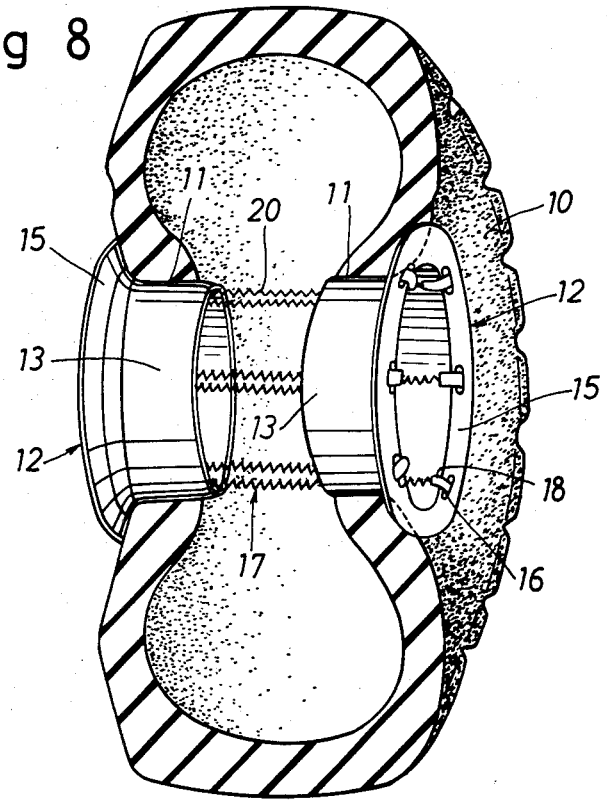
FIG. 8 is a perspective view showing a second embodiment as attached to a tire.
Figure 9:
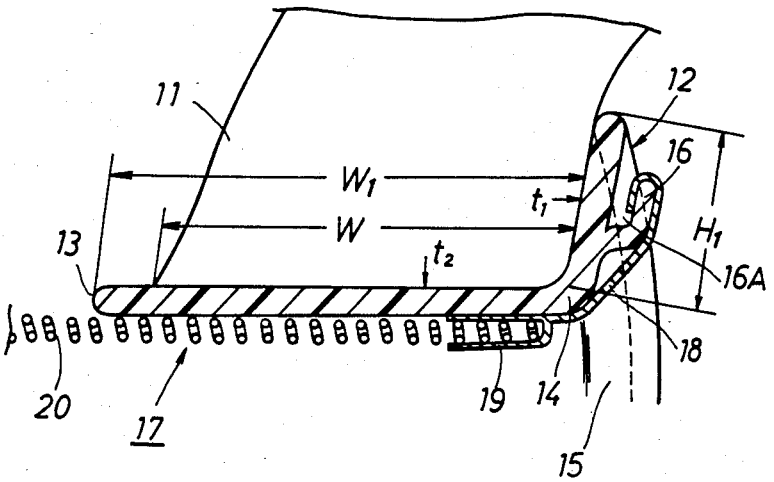
FIG. 9 is an enlarged fragmentary view in section showing the same.
Figure 10:
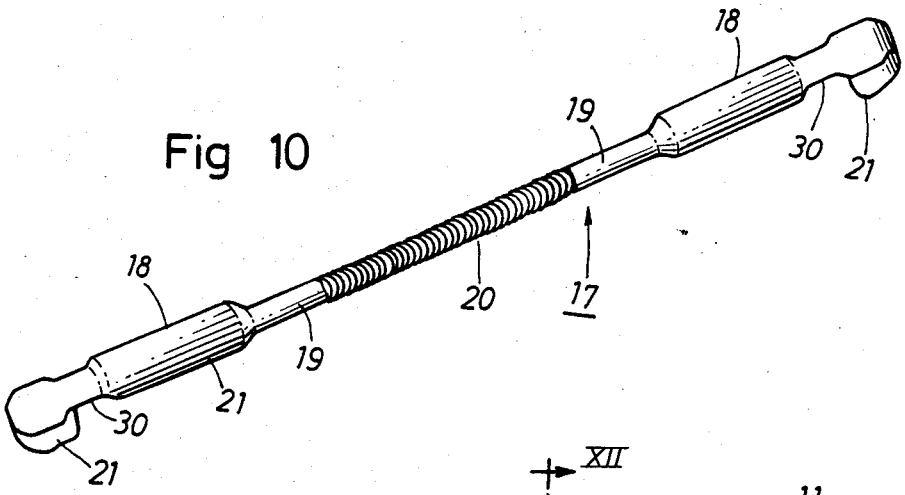
FIG. 10 is a perspective view showing a fastening band included in the second embodiment.

FIGS. 8 to 10 show a second embodiment of the invention comprising bead protectors 12 which have the same construction as those of the first embodiment. Accordingly throughout FIGS. 5 to 10, like parts are referred to by like reference numerals.

Whereas the stretchable portion 20 of the fastening band 17 of the first embodiment is in the form of a solid rubber rod, the stretchable portion 20 of the second embodiment is a coiled spring which is fixedly held in the opposed sockets 19 of plate-like metal members 18.

Accordingly the second embodiment has the advantage over the first that the stretchable portion 20 is less likely to break.

Figure 11:
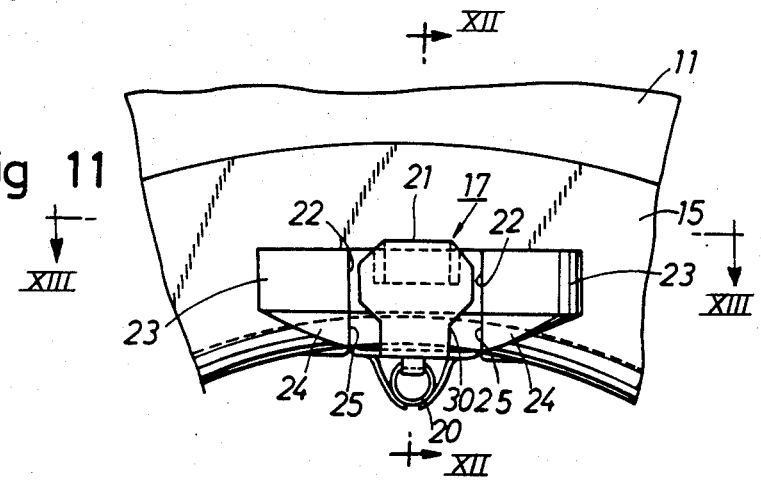
FIG. 11 is a front view showing a third embodiment.
Figure 12:
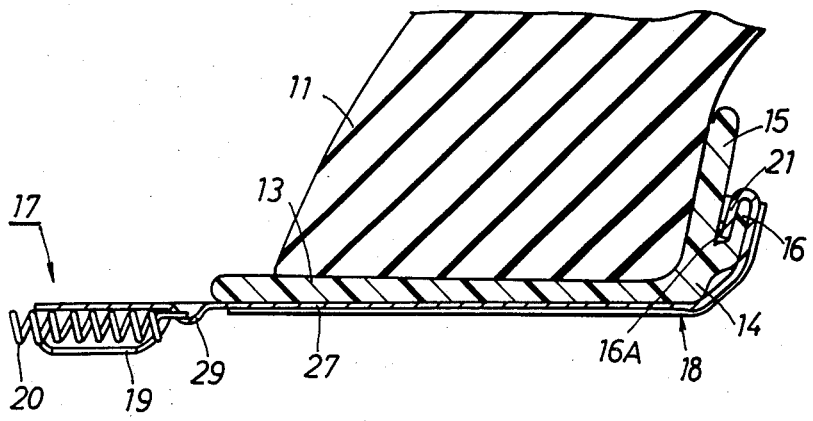
FIG. 12 is a view in section taken along the line XII—XII in FIG. 11.
Figure 13:
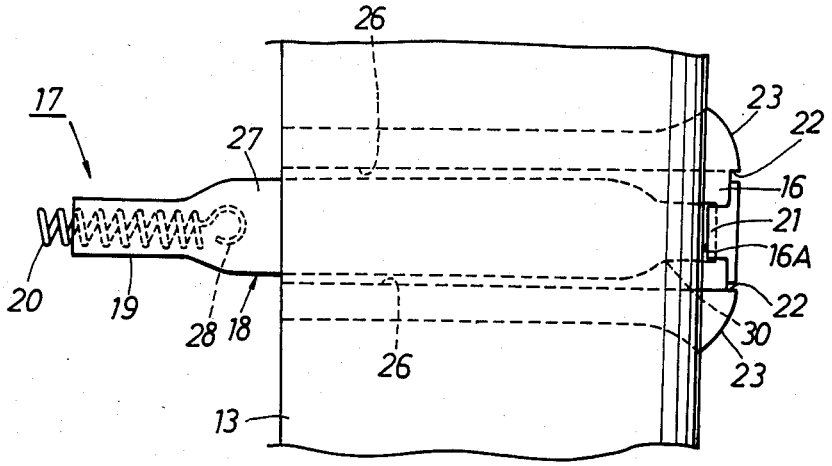
FIG. 13 is a view showing the same as it is seen in the direction of arrows XIII—XIII.

FIGS. 11 to 13 show a third embodiment of the invention which has essentially the same construction as the foregoing first and second embodiments with the exception of the following features or improvements.

The projection 16 is formed in its outer surface with stepped portions 22 for preventing sidewise displacement of the hook 21 of the plate-like metal member 18. The hook 21 is substantially engageable with and disengageable from an engaging cavity 16A. To define the cavity 16A, the projection 16 has arcuate ribs 23 at its circumferentially opposite sides. Each arcuate rib 23 has a radial rib 24.

The stepped portions 22 further extend to the curved portion 14 and further across the tubular portion 13 as indicated at 25 and 26, respectively. The stepped portions 26 of the tubular portion 13 prevent sidewise displacement of the main body 27 of the metal member 18 and are adapted to substantially accommodate the main body 27 in the space between the steps 26.

The metal member main body 27 is in the form of a strip having a length larger than the length $W_1$ of the tubular portion 13. A coiled spring serving as a stretchable portion 20 is loosely inserted through a socket 19 of the plate like metal members 18. A hook 28 of the portion 20 is engaged with a raised lug 29 on the main body 27.

With the tire bead protector device according to the third embodiment, the hooks 21 of the fastening bands 17 are engaged in the cavities 16A over the projections 16 formed on the flange portions 15 of the protectors 12 made of a thermoplastic resin and fitted to the tire bead portions 11. The plate-like metal member 18 has a neck 30 of reduced width, which is bent along the curved portion 14 of each protector 12. With the metal member 18 prevented from sidewise displacement by the stepped portions 22, 25 and 26, the protectors 12 are held to the tire by the elastic force of the stretchable portions 20 against removal axially of the tire. Since the metal member main body 27 has a larger length than the tubular portion 13, the stretchable portion 20 is positioned between the bead portions 11. Because each socket 19 is positioned inwardly of the bead portion 11 axially of the tire, the metal member main body 27 is positioned along the tubular portion 13 axially of the tire, and the hook 21 prevented from sidewise displacement by the stepped portions 22 to prevent the protector from removal from the tire bead portion 11, enabling the protector to preclude damage to the bead portion.

What is claimed is:

1. A tire bead protector device comprising a pair of bead protectors removably fittable to the opposed pair of bead portions of a tire and each comprising a tubular portion with an outer periphery substantially fittable to the inner periphery of the tire bead portion and a flange portion extending from the outer end of the tubular portion with a curved portion formed therebetween to conform to the outer side surface of the bead portion, each of the bead protectors being integrally molded from a thermoplastic resin in an annular form having a substantially L-shaped radial section, and fastening bands each having a stretchable portion for interconnecting the pair of bead protectors axially of the tire with the elastic force of the stretchable portions when the protectors are fitted to the tire bead portions, the device being characterized in that:

the flange portion is formed on its outer side surface with a plurality of projections projecting radially outward thereof to form engaging cavities and arranged circumferentially thereof at a spacing, and each of the fastening bands has a plate-like metal member attached to each end of the stretchable portion and having a hook, the metal member being provided with a planar portion in engagement with the curved portion at the outer end of the tubular portion of the bead protector and bent around the curved portion radially outward to engage the end of the hook in the engaging cavity of the flange portion over the projection.

2. A tire bead protector device as defined in claim 1, wherein the stretchable portion is a solid rubber rod and fixedly inserted in a socket formed on the main body of the plate-like metal member.

3. A tire bead protector device comprising a pair of bead protectors removably fittable to the opposed pair of bead portions of a tire and each comprising a tubular portion with an outer periphery substantially fittable to the inner periphery of the tire bead portion and a flange portion extending from the outer end of the tubular portion with a curved portion formed therebetween to conform to the outer side surface of the bead portion, each of the bead protectors being integrally molded from a thermoplastic resin in an annular form having a substantially L-shaped radial section, and fastening bands each having a stretchable portion for interconnecting the pair of bead protectors axially of the tire with the elastic force of the stretchable portions when the protectors are fitted to the tire bead portions, the device being characterized in that:

the flange portion is formed on its outer side surface with a plurality of projections projecting radially outward thereof to form engaging cavities and arranged circumferentially thereof at a spacing, each of the fastening bands has a plate-like metal member attached to each end of the stretchable portion and having a hook, the metal member being in engagement with the curved portion at the outer end of the tubular portion of the bead protector and bent around the curved portion radially outward to engage the end of the hook in the engaging cavity of the flange portion over the projection, and stepped portions for preventing sidewise displacement of the plate-like metal member of the fastening band are formed in the outer side surface of the projection, the curved portion and the tubular portion, the main body of the plate-like metal member having a length larger than the length of the protector tubular portion in the axial direction of the tire, the metal member main body extending along the tubular portion, a coiled spring serving as the stretchable portion and being engaged at the end thereof with the metal member main body at a location beyond the tubular portion.

4. A tire bead protector device as defined in claim 3, wherein the end of the coiled spring is inserted in a socket formed on the main body.

5. A tire bead protector device comprising a pair of annular bead protectors of substantially L-shaped cross section for removably fitting over opposed bead portions of a tire, each bead protector having an axially extending tubular portion with an outer periphery substantially fittable to an inner periphery of the tire bead portions and a radially extending flange portion connected to the tubular portion by a curve portion that conforms to an outer side surface of a respective one of the tire bead portions; and an plurality of fastening bands for axially interconnecting the pair of bead protectors on a tire under tension, each fastening band having an elastically stretchable portion to each of opposite ends of which a hook-like engagement member of an inelastic material is attached; wherein the flange portion of the bead protectors is provided with a plurality of circumferentially spaced receiving means for radially oriented disengagement by an end of a respective said hook-like engagement member, and wherein each hook-like engagement member being provided with a planar portion for fitting along the curved portion of a respective bead protector when the hook-like engagement member is engaged with its respective receiving means.

6. A tire bead protector device according to claim 5, wherein said receiving means is provided with means for preventing sideways displacement of a hook-like engagement member received thereby.

7. A tire bead protector device according to claim 5, wherein the hook-like engagement members and the elastically stretchable portion of fastening bands are formed of separate parts, each hook-like engagement member being provided socket means for fixedly holding a respective end of the part forming the elastically stretchable portion.

* * * * *